United States Patent [19]

Bernhard

[11] Patent Number: 4,601,566

[45] Date of Patent: Jul. 22, 1986

[54] DAYLIGHT MULTI-REEL FILM LOADER AND DEVELOPING TANK

[76] Inventor: Luis Bernhard, 926 Wilson Dr., New Orleans, La. 70119

[21] Appl. No.: 639,590

[22] Filed: Aug. 10, 1984

[51] Int. Cl.[4] ..... G03D 13/06

[52] U.S. Cl. ..... 354/311; 354/313; 354/316; 354/323; 354/331

[58] Field of Search ..... 354/307, 310, 312, 313, 354/314, 316, 321, 323, 331, 332, 341

[56] References Cited

U.S. PATENT DOCUMENTS

| | | | |
|---|---|---|---|
| 2,082,962 | 6/1937 | Lesjak et al. | 354/313 |
| 2,345,682 | 4/1944 | Neuwirth | 354/313 |
| 2,359,611 | 10/1944 | Bolsey | 354/310 |
| 3,703,859 | 11/1972 | Katsuragi | 354/310 |
| 4,001,852 | 1/1977 | Gall | 354/313 |
| 4,134,666 | 1/1979 | Kikuchi | 354/313 |

FOREIGN PATENT DOCUMENTS

| | | | |
|---|---|---|---|
| 641858 | 2/1937 | Fed. Rep. of Germany | 354/313 |
| 2434033 | 1/1976 | Fed. Rep. of Germany . | |

*Primary Examiner*—A. A. Mathews

*Attorney, Agent, or Firm*—Keaty & Keaty

[57] ABSTRACT

A daylight loading film developing tank is shown, specifically adapted to permit sequential loading and a simultaneous developing of multiple reels of film under non-darkroom conditions.

The tank has a removable upper film loading chamber containing a removable dark slide which permits the light-tight isolation of a developing tank chamber inner portion from the reel loading and film inserting portion of the daylight loader top. A separate, fully baffled, chemically passing developing tank cap is provided. A coordinated series of mating threads within the film loader top, the developing tank top, and the developing tank permit the chemical passing baffled tank top to be inserted into the developing tank through the interior of the film loading chamber of the daylight loading top. The daylight loading top portion can then be removed, converting the tank to a standard light-tight film developing tank suitable for sequential chemical processing. The overall system permits, without the use of a darkroom, a number of individual rolls of film to be sequentially loaded onto reels; these reels are then removed to a multi-reel film developing tank. The invention has a developing tank which can be enlarged by adding sections to it, permitting the invention to be used with any of a number of desired quantities of film reels.

7 Claims, 9 Drawing Figures

DAYLIGHT MULTI-REEL FILM LOADER AND DEVELOPING TANK

BACKGROUND OF THE INVENTION

The development of photofilm in small quantities by those, such as photo hobbyists or others, who require the capability of developing a few rolls of film at irregular intervals has led to the development of a number of the so-called daylight developing tanks. Essentially, the purpose of these devices is to permit film to be developed in small quantities without requiring the use of a full darkroom facility or a sequential developing machine, such as is common in the mass production of developed film.

All photofilm is light sensitive. Further, exposed photofilm, by reason of certain reactions that occur when the silver nitrate or other sensitized portion of the emulsion is exposed to light, is more sensitive to light than unexposed photofilm. Thus, there is a particular problem in handling exposed film which is to be developed in isolating it from any inadvertant light exposure while removing the film from the cartridge, in which it is encased, and placing it upon a mechanism which permits the free passage of chemicals so that the developing steps can freely progress.

The most widespread still picture film currently in commercial usage is provided, by a general industry standard, in the form of a 35mm-wide film having sprockets for mechanical movement of the film running each of two edges and is provided in certain fixed lengths upon small light-tight cassettes of a uniform construction. The majority of photo hobbyists use such film; in addition, a significant number of professional photographers also use this so-called 35 mm film.

The general steps to developing a single roll or a small number of rolls of such film start with the cassette of exposed film. It will be found that one end of the film protrudes from a light baffle opening on a side of the film cassette. This film end is then fastened to a reel having spacing system such as spiral ridges that permit film to be wound upon the reel, spacing sequential turns of the film a distance apart so as to permit the free passage of chemicals to facilitate development. The reel, so wound, is then immersed sequentially in a series of chemicals or rinses, all according to a particular pattern specified by the film manufacturer so as to permit the latent image on the film to be developed into a sensible, visual image.

It has become common to provide, for the chemical processing steps, a light-tight container which can hold the reels of film. Such containers usually comprise a closed container either of metal or of an opaque plastic, a removable light-tight baffled lid that permits the pouring in or pouring out of liquid solutions, and internal spaces or dimensions adapted to holding a finite number of reels of film. The reels are loaded in the dark with the film, inserted in the tank, and the light-tight lid placed upon the tank so as to enclose the reels. At this point the tank and lid protect the reel from exposure to light and the entire tank assembly can be manipulated in a lit area. For this reason these tanks have come to be known as daylight developing tanks.

A more limited number of developments have attempted to automate the loading of the reels for development process. Individual film cartridges for 35 mm must, for their intended use be light-tight; they contain a light baffle at the point where film exits or enters the cartridge. As a result, the reverse apparatus, daylight loaders for film cassettes from bulk reels of film, represent a relatively simpler problem and have long been available in the art. An apparatus for the loading of reels, however, must deal with the fact that film developing reels must be relatively open to permit the passage of chemicals and, for certain films, permit re-exposure to light, all as part of processing steps. As a result the film developing reels themselves cannot be light-tight. Thus, once film has been loaded upon developing reel, the entire reel must be permanently maintained in a dark condition, free from exposure to light. There are several kinds of loading reels among which two species are more popular, the so-called professional type which does not contain movable parts and is loaded by inserting one extreme of the film, or lead, on a retaining clip located near the center on the member that has attached to it both, top and bottom flanges. Once the film is secured and properly aligned, the operator presses both edges of the film to clear the outer grooves of reel as it is turned continuously to load it in an inside-out fashion pulling the film out of the casette.

The other type of reel has flanges that can be moved back and forth in a reciprocating manner. This type of reel is loaded by introducing a length of film in the take-up film grooves to a point where the film pulling or trapping elements are. Some models have a small steel ball and others have a protrusion that engages the film perforations. These two types trap the film edge when one of the flanges is moved clockwise, thus pulling the film out of the cassette. When said flange is returned (counterclockwise) it releases the grip on the film edge and the other flange traps the other film edge to prevent it from returning. These procedures are continued until entire film is loaded; since this operation is carried out by hand, there is the real risk of leaving finger marks or scratches. The perspiration on the fingers of the operator can damage the image area because it has a degree of acidity which acts as a fixer on the emulsion.

This requirement that the loaded developing reel be isolated from any light sources has lead to a restriction on most current daylight loading devices for developing reels that only one reel can be loaded and developed at a time. These devices are impractical when several rolls are to be developed. It obviously takes more time to develop one roll after another. But, furthermore the operator, after having developed a roll, must dry or wait until tank and reel are completely dry to procede with the development of the next roll, making the procedure a lengthier one. Alternatively, structures for the loading of multiple developing reels have required that the reels be gang-loaded; that is, the assemblage must be set up with all the necessary film cassettes and reels at one time and successful operation requires that the reels be loaded simultaneously by mechanical takeup means. Any jamming or defects not only endangers the specific film jammed, but also results in the destruction of all other rolls of film involved.

The fact that the reels must be exposed to chemicals also results in the necessity that the loading mechanism also is generally exposed to the chemical solutions. This not only produces severe adverse affects upon the loading mechanism, as many photo chemicals are intensively corrosive, but it also requires a relatively greater amount of chemistry per unit roll of film developed. Some of the existing one roll loading-developing tanks have the film cassette housing within the developing chamber, or connected to it by the film passage corridor without a provision to hermetically separate one from the other. So when the chemicals are poured in for processing they also flood or fill the cassette housing and film passage corridor making it necessary to utilize extra amounts of chemicals to reach a level to properly bathe the entire film. The tank shown in U.S. Pat. No. 2,434,033 (German) has a film cassette holding chamber within the developing chamber thus increasing the inner dimensions and making it necessary to use a larger amount of chemicals. Photo chemicals are expensive, and also pose some degree of environmental hazard, and creating disposal problems, such wastage of photo chemicals is to be avoided. Other tanks have the loading means or peripheral projection for receiving the cassette, in such a disposition that, during the agitation of the developer, this projection will cause a disturbance creating an uneven flow that can result in an uneven development. U.S. Pat. No. 3,703,859 shows a tank to load a "plurality of rolls" adapted for 16 MM. If this tank were to be also adapted for 35 MM film, it would be necessary to increase the diameter of the tank to a very large and impractical size to accommodate the length of these films. It would require more chemicals per roll and it would only work with films having the same length since it could not properly unwind films of different lengths. Its construction would only allow movement to unwind the shortest roll.

U.S. Pat. No. 2,082,962 shows a single roll loading and developing tank that contains a reel in a vertical position; the inventor indicates that little amount of chemicals is necessary for processing since the reel is in this vertical position, the tank needs to be only half-full, thus covering half of the reel, which therefore has to be revolved continuously to develop the film. It is to be noted here that such continuous agitation during development results in a highly "contrasty" negative. It is known that when the developer is touching the film emulsion the developing power of the developer is diminished in the portions of the image that have been more exposed to light. This fact permits the less exposed areas to be developed at a relatively faster rate rendering a more balanced image. Manufacturers of film indicate that the developing film should be stirred once ever so often. This replenishes the developer in the high density areas at the opportune intervals.

The continuous stirring of the developing roll therefore renders a high contrast unbalanced and uncontrolled developed image.

BRIEF DESCRIPTION OF THE DRAWINGS

FIG. 6(*c*) shows a front view of one embodiment of slot 40 and reel retainer 44, showing a curve for prevention of scratching of the film.

SUMMARY OF THE INVENTION

Figure 1:
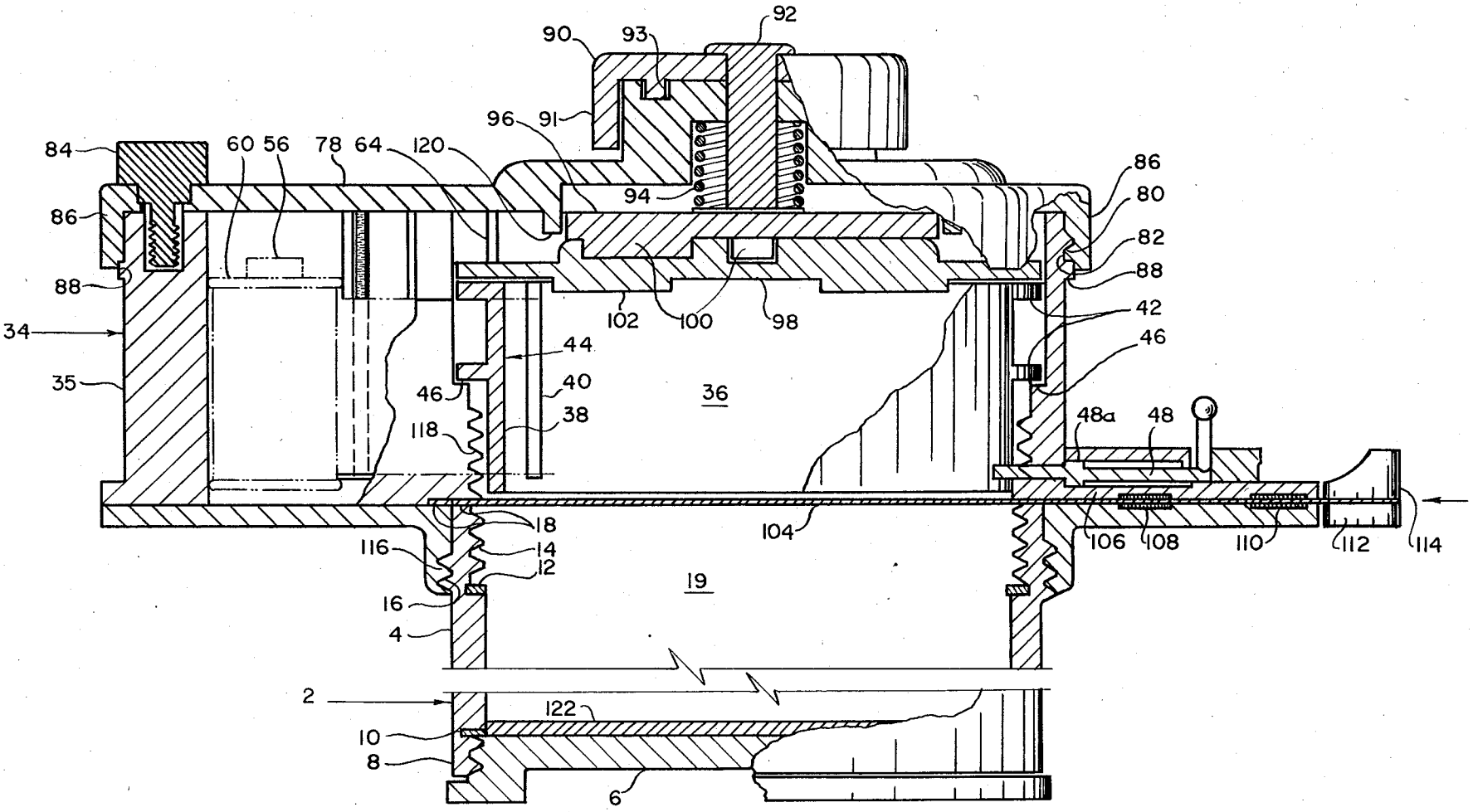
FIG. 1 is a side view, cut away section of the apparatus of the present invention.

The current invention discloses a combination daylight developing tank and daylight film loading mechanism which permits the sequential loading of a desired number of developing reels fron 35 mm cartridges or the like, all while permitting the maintenance of light-tight or dark conditions protecting the exposed film which has been placed on the developing reels.

The invention has, in combination, a coordinated assemblage of three major components. The first is a sectionally adjustable or enlargeable developing tank for the receiving of loaded reels of film and for containing the chemicals necessary to develop the films. The second is a loading head with a light-tight means to isolate the developing tank from the reel loading mechanism and a reel loading mechanism adapted to the repeated daylight loading of developing reels from film cartridges.

The third component is a chemical passing developing tank head adapted to close off the top of the developing tank when it is full of reels of film to be developed, in a manner that permits the removal of the film loading mechanism before the developing steps commences. Loading head works in conjunction with chemical passing tank cap in a way that permits the latter to be affixed upon developing tank top, also permitting the removal of the loading head from tank, all while maintaining the light tight integrity of the developing tank.

It is thus an object of this invention to provide a daylight system permitting the sequential removal of exposed photo film from film cartridges or rolls and the developing of said film without the use of a darkroom.

It is a further object of this invention to provide a daylight film developing system which permits the development of multiple reels of film simultaneously.

It is a further object of this invention to provide an apparatus to load film on reels of a variety of designs, including several models of the so-called professional inside-out-continuous motion loading reels and several models of the reciprocating motion type loading reels, including also reels that hold rolls of more than 36 frames or exposures, or long rolls.

It is a further object of this invention to provide an apparatus with an unrestricted drive mechanism capable of loading in a continuous revolving motion, or in a reciprocating back and forth motion.

It is a further object of this invention to provide a mechanism to maintain cassette, film and reel alignment for the reel loading operation.

It is another object of this invention to provide a daylight developing tank system that can be sectionally adjustable to accommodate any desired amount of developing reels, also adapted for inversion.

It is another object of this invention to provide a daylight film loading and developing system that permits the removal of the developing tank from the loading head, thus providing a tank of smooth inside configuration to eliminate the uneven development that can be caused by the cassette housing as it is found on other existing developing tanks.

It is a further object of this invention to provide a means also to mechanically load existing reels thus eliminating the risk of film damage due to finger contact or other kinds of physical contact.

It is another object of this invention to provide an apparatus particularly suited for film containing cassettes of the 35 MM. kind or the like.

It is a further object of this invention to provide an apparatus with a combination of self-centering and self-engaging members to drive the reels during the loading operation.

It is another object of this invention to provide a developing tank with a removable bottom to facilitate film washing.

It is another object of this invention to provide a developing tank that can accommodate film reels of different sizes or diameters simultaneously.

Another object of this invention is to provide an apparatus with an efficient means to transfer the loaded reels from the loading chamber to the developing tank maintaining light-tight conditions.

It is another object of this invention to provide an apparatus with a loading head developing tank and developing tank chemically-passing light-tight cap, all disposed or adapted to permit said cap to be attached to developing tank for the daylight development of film.

It is an object of this invention to provide a daylight film developing reel loader and developing tank which permits the loading of a variable number of film reels and their subsequent simultaneous development without the use of a dark room.

Other advantages of this invention may be appreciated by referring to the following drawings and description.

DETAILED DESCRIPTION OF THE PREFERRED EMBODIMENT

FIG. 1 shows the developing tank 2 comprising a cylindrical wall section 4 extending vertically down and sealingly closed off with a bottom section 6. In an embodiment of the tank made substantially of plastic, the bottom 6 further comprises a separate disk with an adapting screw section 8 for securely affixing the bottom 6 to the wall 4 and a chemical resisting seal 10 for preventing the leakage of chemicals or liquids through the joint formed between the bottom 6 and the wall 4. Bottom 6 has also attached a non-absorbing chemically-resisting member of a cushioning nature, 122 to absorb the impact of the reels when said reels are dropped into the developing tank chamber 19 upon bottom 6.

At an upper end of the developing tank 2 is found an interior annular upper inner cap seal 12. In this embodiment, cap seal 12 is an annular sealing ring disposed upon an upward facing shoulder. Immediately above the cap seal 12 is an upper inner cap receiving screw 14, rising vertically to the upper edge of developing tank 2. Parallel to the inner receiving screw 14 but extending on the outer surface of the wall 4 along its upper edge is an upper outer loader adapting screw 16. The top of the developing tank wall 4 is smooth to form a substantially smooth, light-trap slide contacting end edge surface 18. The wall 4 and the bottom 6 of the developing tank 2 form a reel receiving chamber 19.

Figure 3:
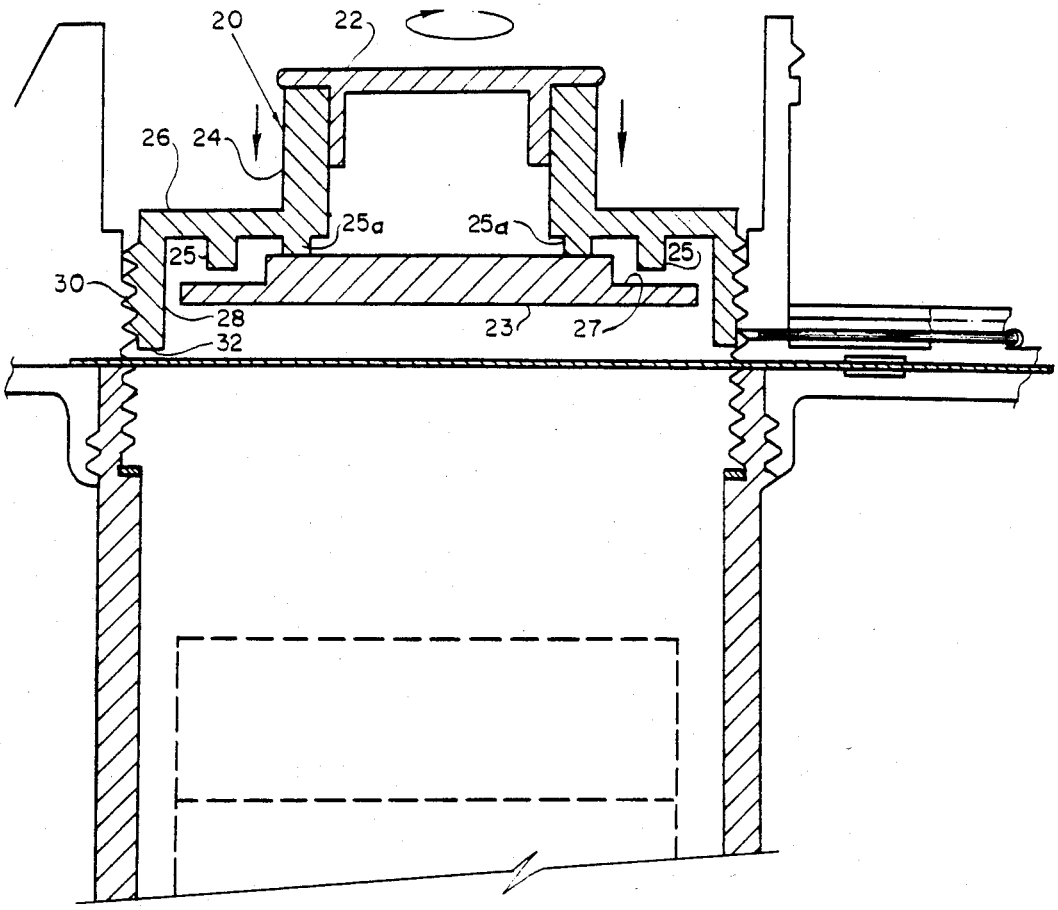
FIG. 3 is a section veiw showing the insertion of the alternate top cap.
Figure 4:
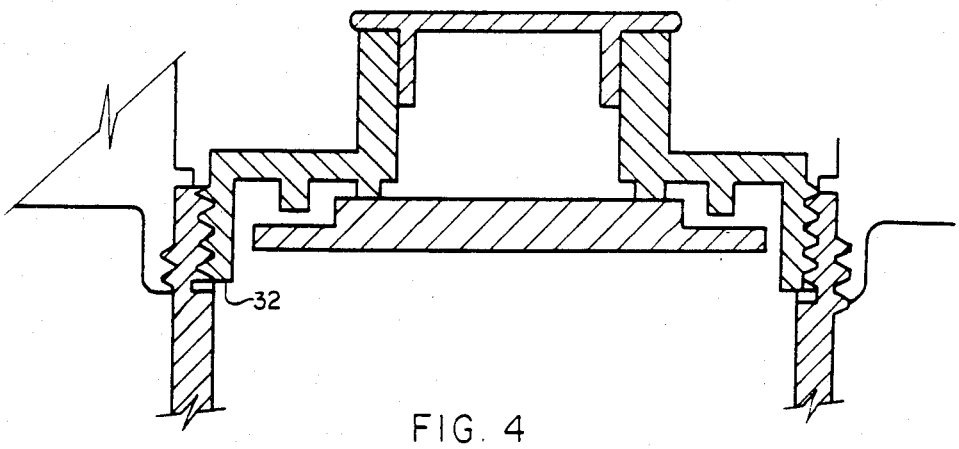
FIG. 4 is a view showing the alternate top cap installed in the tank lower section.

Turning to FIGS. 3 and 4 there is seen the developing tank cap 20 having an outer cap 22 which is tightly, frictionally seated within an upper fluid receiving cylindrical neck 24 of the cap 20. The outer surface of neck 24 contains ridges or a configuration to provide good grip when said cap is screwed in place. At a lower extremity of the cylindrical neck 24 is a continuous, outwardly extending disk extending section 26, which extends to create a diameter and mating with the diameter of developing tank wall 4. The disk extending section 26 is then extended downward into a lower engaging thread section 28, forming thereby the overall outer shape of the developing tank cap 20. On the outer edge of the lower engaging thread section 28 are engaging threads 30 adapted to engage rotationally and fasteningly with the inner cap receiving screw 14 of the developing tank 2. The lower edge of the developing tank cap 20 has a sealing bottom edge 32, sustantially smooth and cylindrical for compressibly engaging, sealingly with the upper inner cap seal 12 of the developing tank 2, forming thereby a substantially liquid-tight seal. Within the inner cylindrical area defined by the disk extending section 26 and the lower engaging thread section 28 is found an inner chemical baffle plate 23, which is of a substantially opaque nature having a non-reflective surface and which closes off the opening provided through the upper fluid receiving cylindrical neck 24 against the passage of light into the interior of the developing tank 2 when the developing cap 20 is sealingly engaged by the mating of the respective screw threads 14 and 30. The inner chemical baffle plate 23 is attached to bottom surface of disk extending section 26 and spaced from it by repeating baffle spacers 25A; spacers 25A are both opaque and not reflecting and serve to further reduce the possibility of light leakage to the interior of cap 20. The baffle spacers 25A also, by spacing the chemical baffle plate 23 a distance from the disk extending section 26 form a chemical flow passage 27. Chemical baffle 23 has a depression or indentation around the entire outer perimeter and placed above said depression but without touching, is found a circular neck 25 light baffle, also of opaque nature. Said neck is fixed to the bottom surface of disk extending section 26. Both depression and neck also form light-tight liquid passage 27. The chemical flow passage 27 permits the free flow of liquids from the fluid receiving cylindrical neck 24 pass the inner baffle plate to the reel receiving chamber 19 of the developing cap 2.

Figure 2:
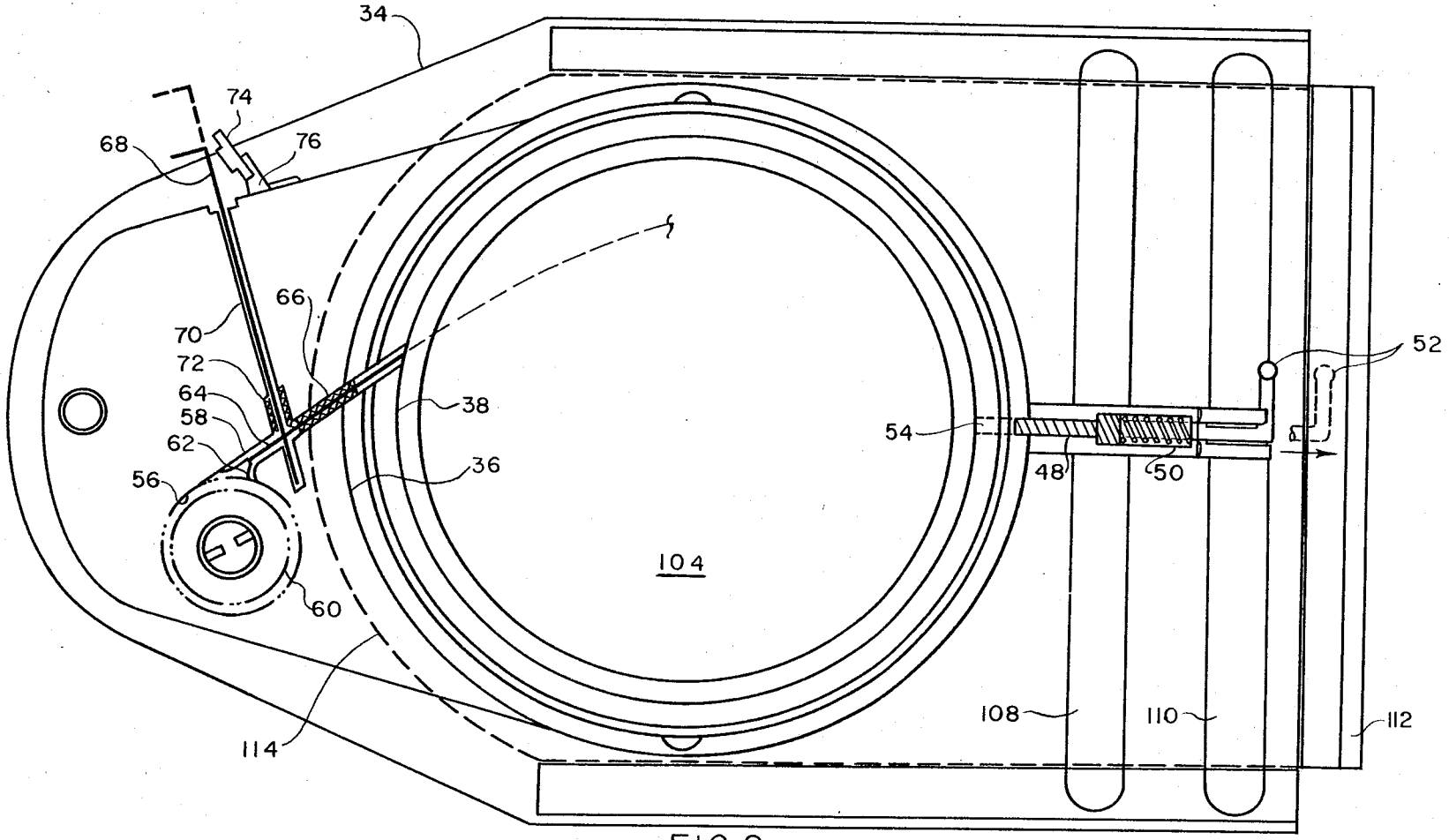
FIG. 2 is a top section of the invention looking downward, sectioned immediately above the light baffle.

FIGS. 1 and 2 show, in two views, the overall film loading head 34 of the current invention. It is to be noted in this view that the developing cap 20 is not shown, being for this view completely removed. Loading head 34 comprises a vertical wall section 35 which defines internally a developing-reel chamber 36. Within reel chamber 36 is found snuggly, but removably, inserted reel support insert 38. A plurality of reel support inserts 38 may be provided with the overall loading head 34; each of the individual reel support inserts 38 will be sized to support a particular size of developing reel, such developing reels being well known to the art. At one point around the periphery of the reel support insert 38 is found an insert film entrance or guide 40. Since the reel support inserts 38 may be of different diameters, depending upon the diameter of the reel being supported, insert centering spacers 42 are provided to center the insert 38 within the reel chamber 36. It is to be noted that a plurality of centering spacers 42 are circumferentially disposed about the outer surface of the insert 38. This plurality is to ensure a substantially vertical positioning of the support insert 38 so as to preserve the rotational axes of the developing reel corrected support 38 and the film cartridge as will hereinafter be explained as parallel axes. The interior of the reel support insert 38 defines a cylindrical, smooth reel support surface 44 sized to support a developing reel, but permit free rotation of the developing reel. The inserts 38 are positioned within the overall reel chamber 36 by being supported upon an insert support shoulder 46, designed to support the lower protrusions of the plurality of the insert centering spacers 42 and providing a vertical positioning for reasons to be hereinafter described.

Figure 5A:
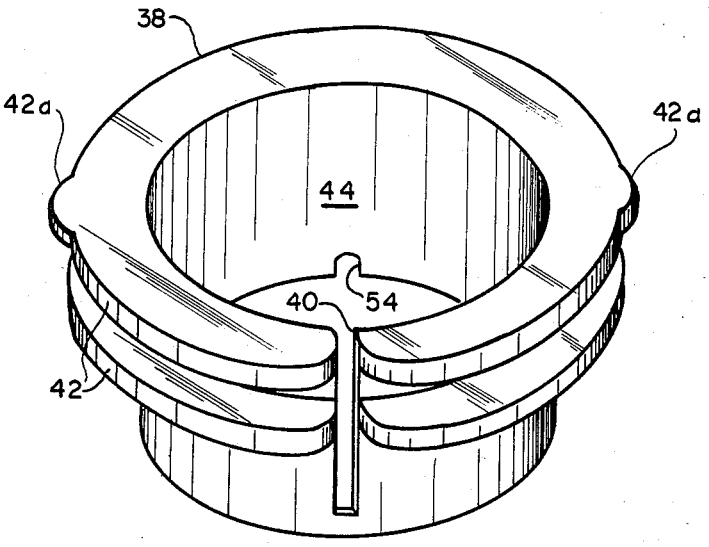
FIG. 5(*a*) and FIG. 5(*b*) show alternate forms of the reel retainer 44.
Figure 6A:
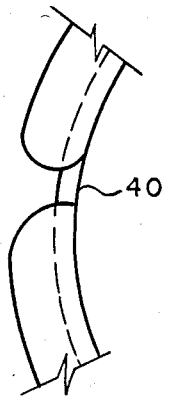
FIGS. 6(*a*) and 6(*b*) show a top detailed view of alternate embodiments of slot 40 in reel retaining means 44.
Figure 5B:
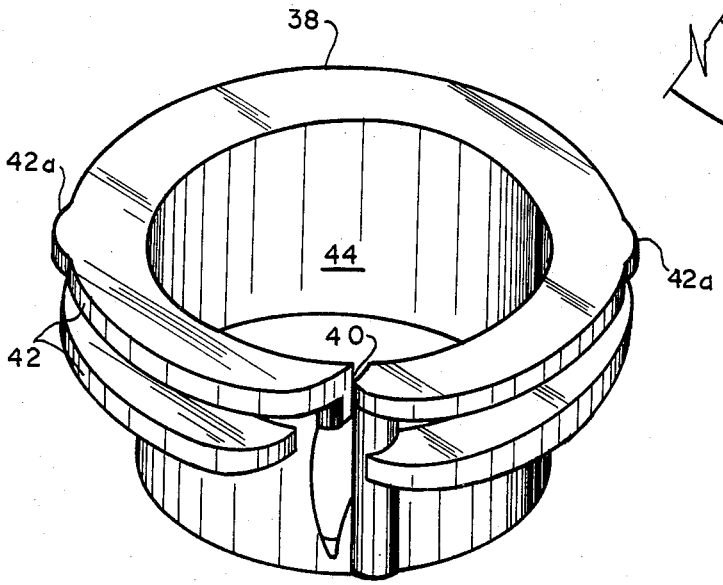
Figure 6B:
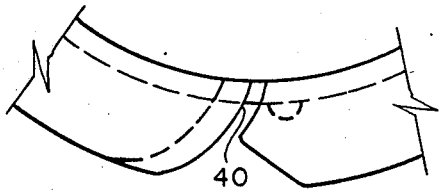
Figure 6C:
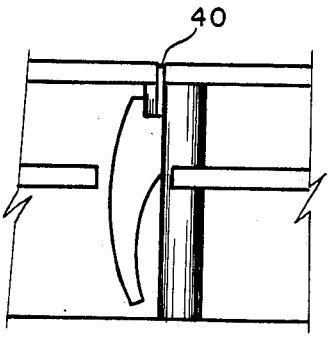

In as much as the reel support inserts 38 are to support developing reels which are to be rotated, a means is required to prevent the reel support insert from rotating, thereby misaligning the insert film passage or guide 40. Therefore, the upper centering spacer 42 has two protrusions 42A See FIGS. 5B and 5C. Disposed at and extending beyond outer perimeter of said spacer 42 these protrusions engage with two corresponding indentations adapted to accommodate said protrusions when reel supports 38 are fully inserted, thus freezing reel supports 38 into position insuring proper alignment during loading operation. In this embodiment a bottom reel flange locking pin 48 is found extendingly disposed within the loading head 34. The insert locking pin 48 is in turn spring-loaded by locking pin spring 50 to an inwardly projecting position. A handle 52 is provided to permit temporary withdrawal of the insert locking pin 48. A mating insert locking notch 54 is provided at a location within the support insert 38 to permit the passage of locking pin 48. The housing of locking pin 48 has two extensions on both sides of the extreme end, said extensions have each an indentation to accommodate pin 48 in a retrieved position, by rotating the handle 52 while pulling it and inserting said handle 52 on either of the indentations. Locking pin 48 is provided to be used only with the reciprocating type reels, and its function is to trap the bottom flange of said type of reels. When the pin 48 is released from handle holding indentations, the spring action pushes the pin 48 towards the inside of chamber 36 (with reel support 38 and corresponding reel in place). Said pin passes through notch 54 of reel support 38 (it is to be noted that only the reel supprots 38 designed to accommodate reciprocating type reels, have this notch 54, in the case of the other, continuous rotation reels, the entire reel revolves in the loading operation so locking pin 48 is not to be used for these reels). Locking pin 48 is of sufficient length so that when activated by spring 50 said pin can travel into chamber 36 to push against the bottom flange of the reel in use. (Note, locking pin 48 is positioned at the same level with lower flange of reel). It is also to be noted that pin 48 has a cylindrical protrusion **48*a* that serves as a light baffle to avoid light leakage from the entrance orifice of pin 48. Turning to the flange trapping action of locking pin 48, it should be said that this is a provision to prevent the sympathetic turning of the bottom flange of reel when top flange is being moved back and forth during the loading operation, thus maintaining proper alignment of the reel film entrance grooves with the reel support entrance 40**.

Turning primarily to FIG. 2, there is vertically disposed within the loading head 34 a cartridge support aperture 56. Cartridge support aperture 56 is designed to enclose a standard film cartridge of known design that is constructed so that the axis of the film cartridge 60, inserted within the cartridge support aperture 56, will be parallel with the rotational axis of a developing reel within the reel support insert 38.

It is known that film cartridges 60 will have a projection 62 which serves to align the film cartridge 60 against rotation within a camera. Provided within the loading head 34 is found an angled alignment notch 58 extending out from the cartridge support aperture 56. Alignment notch 58 is sized and shaped so as to engage alignment projection 62, and thereby aligning an inserted film cartridge 60 to a single position, freezing film cartridge 60 against further rotation.

Extending outward from the alignment notch 58 into the reel chamber 36 is a substantially straight film guide passage 64, adapted to permit the passage of an extension of photofilm which can be paid out from the film cartridge 60. Within the film guide passage 64 there is provided a light baffle 66, permitting the passage of film but preventing light from leaking between the reel chamber 36 and the cartridge support aperture 56. This light baffle, as the other light baffles to be described, is preferrably composed of two facing pieces of velvet or a similar opaque, non-reflective and non-scratching substantially fibrous material. Extending at an angle to film guide passage 64 is a cutter blade passage 70, containing therein a removable film cutter blade 68. Within the cutter blade passage 70 there is provided a cutter blade passage light baffle 72. Light baffle 72, as baffle 66, is preferrably constructed of opposing, substantially elongate pieces of dark velvet or the like. Since cutter blade 68 is fully removable from passage 70, an opening baffle 74 is provided with a mating opening notch in the outer wall of loading head 34 to further close off the interior of loading head 34 from light while permitting the insertion of the removable cutter blade 68 as required. Opening baffle 74, therefore, pivots hingedly upon a hinge pivot 76, fixedly mounted to an outer wall of loading head 34.

The upper surface of loading head 34 is closed by the provision of a removable loading head lid 78. Head lid 78 has a substantially flat, opaque lid conformly constructed to the outer wall shape of loading head 34. In order to ensure a light-tight seal, loading head lid 78 is provided with a lid lip edge 86, downwardly extending for a distance around the outer periphery of the lid 78, enclosing thereby the entire wall of the head 34. At one extreme edge of loading head lid 78 there is found a lid locking protrusion 80 which engages to a lid locking notch 82 provided adaptingly upon the outer edge of the head 34. At a second extreme edge of the lid 78 is found a lid locking screw 84 which cooperatively engages with and locks down into the loading head 34 so as to fixedly engage the lid 78 tightly about the head 34. The locking screw opening on lid 78 is shaped to match the shape of the shoulder of said screw 84 to provide a light tight engagement. A lid positioning shoulder 88 is further provided about the outer periphery of the loading head 34 so as to provide a spacing and positioning means for controlling the spacing of the loading head lid 78 and providing a limit to the downward travel of the lid 78 as the locking screw 84 is engaged. Said lid positioning shoulder 88 is also a light baffle that prevents any light from coming inside loading head 34 when lid 78 is fully affixed to loading head 34. At the point when lid 78 is fixed upon head 34, the top of head 34 is in snug contact with the lower surface of top of lid 78, also providing a light tight seal.

Extending from the outer top surface of the lid 78 is found a rotatable film reel turning knob 90. Turning knob 90, in turn, engages through an axle 92 protruding through lid 78 to drive pressure plate 96. A loading spring 94 is provided so as to provide a positive downward pressure on pressure plate 96 while permitting the lifting of film reel turning knob 90 so as to raise pressure plate 96, as will be hereinafter described. Film reel turning knob 90 extends downwardly over upward projection in loading lid 78 to form a light baffle edge 91. In addition, an inner light baffle 93 extends downward into a mating, annular notch within lid 78. In combination, both edge 91 and inner baffle 93 prevent the leakage of light from the exterior of the tank through the opening provided to receive axle 92 from the outside of lid 78 to the inner chambers formed by lid 78 on loading head 34.

Pressure plate 96 in turn engages with rotary engaging plate 98, which is axially self-centering since its outer perimeter fits snugly, but permitting rotation, with top inner perimeter of chamber 36. Pressure plate 96 is axially centered with loading chamber 36 by axle 92 and a circular shoulder under lid bottom 120. Rotary engaging plate 98 and pressure plate 96 engage automatically when knob 90 is rotated, (lid 78 being fixed to head 34) spring 94 pushes down on plate 96 during rotation of knob 90 and at some point projections 100 will be aligned to engage with similarly shaped engaging notches of plate 98. In turn, 98 is also being pushed downwards against top surface of reel, the lower face of engaging plate 98 is provided with reel engaging projections 102, adapted to engage with found projections or adapations within a developing reel for permitting the developing reel to be rotated. It is known that all developing reels, by construction, are provided with some form of projection or interlocking notch permitting the reel to be rotated in the developing tank. When plate 96 and 98 are engaged both turn together still pushing down until said projections 102 engage with projections of the reel, at this point the operator imparts the required kind of motion to load the reel being used. It is to be noted here that the operator will be able to "feel" the aforementioned engaging actions since there is a distinctive downward audible motion when the components engage. There are only 2 engagements to occur. One between plates 96 and 98 and one between plate 98 and reel. Therefore, the operator can easily determine when the actual loading should commence. Various rotary engaging plates 98 may therefore be provided to engage with developing reels. It is to be noted here that the top engaging notches of the various engaging plates 98 are all of the same shape and size since they all are to be engaged with the projections 100 of the permanently mounted plate 96. Only the bottom projections 102 will vary in shape from plate to plate to accommodate to a particular reel.

The upward motion of knob 90 transmitted through axle 92 against the force of spring 94 serves to raise pressure plate 96. This in turn disengages the plate interlocking projections 100, disengaging the pressure plate 96 of the rotary engaging plate 98.

Found at the substantially bottom surface of head 34 is a light blocking slide 104. Light blocking slide 104 extends sealingly and closingly and across the entire bottom of reel chamber 36, closing reel chamber 36 off totally from the reel receiving chamber 19 of developing tank 2. Light blocking slide 104 is receivably engaged within light slide aperture 106, provided within the lower section of head 34. Within light slide aperture 106 are found first light slide baffle 108 and second slide light baffle 110, which extending across and beyond the width of both faces of light blocking slide 104, prevent any ingress of light or illumination to within reel chamber 36 when light slide 104 is removed. Both baffles are preferably made of dark velvet material, each opposing baffle strip is placed in such proximity as to permit the insertion of slide 104 but also in a way that the bristles intertwine in a light blocking manner when slide 104 is removed. Light slide 104 is provided with a substantial light slide handle 112, engagingly sealed to the outer extreme of slide 104. Handle 112 is provided to permit the removal of light slide 104 from light slide aperture 106. When slide 104 is fully inserted it provides a light-tight seal for chamber 19 of tank 2 when lid 78 is not affixed to head 34. Once lid 78 is in place slide 104 can be removed to drop the reels onto chamber 19 maintaining a light-tight condition of said chamber 19.

Extending downward from the base of loading head 34 is found tank engaging thread section 116, which is extended and adapated to engage matingly with upper outer adapting screw 16 of developing tank 2. Tank engaging thread section 116, therefore, when rotationally screw engaged with developing tank 2, locks together developing tank 2 and loading head 34 to form a unitized structure.

Within the lower, inner surface of loading head reel chamber 36 is further provided an inner threaded section 118. Inner threaded section 118 is threaded so that when tank engaging thread 116 are firmly affixed to the loader adaptor screw 16 of developing tank 2, inner threads 118 of reel chamber 36 and cap receiving screw 14 of developing tank form a continuous, uniform threaded section, adapted to engage with developing tank cap 20's lower engaging screw thread 30. Thus, inner screw threads 118 and 14, together, are adaptingly formed so that lower engaging thread section 28 of developing tank cap 20 may smoothly and non-bindingly engage an essentially continuously threaded section, formed by the conjunction of the reel chamber 36 of loading head 34 and wall section 4 of developing tank 2. It should be noted here that passage 64 viewed from the center of chamber 36 would look like a vertical narrow opening extending from the top inner wall of chamber 36 on down through set of threads 118 but with the exception of the last thread loop of threads 118. The bottom level of passage 64 is slightly above said last loop of threads 118, therefore said loop is not cut or interrupted by passage 64, and when cap 20 is screwed on threads 118 to a point where bottoming edge 32 touches the top surface of slide 104, the last bottom loop of threads 30 has engaged past the last loop of threads 118 insuring the light-tight integrity of chamber 19 once slide 104 has been removed to allow the downward rotation motion of cap 20 to engage thread 14 of tank 2. It should be noted here that passage 64 creates a small separation or gap on threads 118 (with the exception of the last bottom loop as stated) this gap, however, does not in any way disturb the general continuity of threads 118 permitting a nonbinding rotational engagement with threads 30 of cap 20.

In operation, a film reel, if reciprocating type is being used, is loaded, first by inserting a length of film in the take up grooves as far in as required by the reel manufacturer. Then the corresponding reel support is inserted inside chamber 36, (locking pin 48 is in the withdrawn position at this point) then reel with film lead inserted and cassette are all inserted in their corresponding places, that is reel inside reel support 38, film cassette inserted within cartridge support aperture 56 and film lead or litter through film guide 64, thence through insert film guide 40 thence into film reel. At this point the corresponding engaging disk 98 is inserted in chamber 36 above reel and reel support (so that faces touch the corresponding engaging surfaces), then locking pin 48 is released thus activated to hold or trap bottom flange of reel. If the professional type reel is being used, the loading sequence is as follows. Film lead is attached to reel clip as required, the reel is then inserted within corresponding reel support 38 guiding the film lead into guide 40 FIG. 5B and placing it inside the curved opening of said guide 40. It should be said here that all reel supports 38 designed to be used with the professional type reel models, have the same kind of guide opening 40, said opening has a curved section or passage for the film and the distance or clearance from the bottom of this passage to the top is somewhat shorter than the width of the film so that when the film is placed inside it is slightly pressed at the edges thus assuming a curved shape. This enables the film to clear the outer ridges or grooves of the reel during loading. Then reel, reel support, film, and film cartridge are all inserted inside head 34 accordingly (locking pin 48 is kept withdrawn when this type of reel is used, as stated before), then the corresponding disk 98 is inserted accordingly. The loading head lid 78 is then engaged with loading head 34 by engaging the lid locking notch 82 and the lid locking projection 80, thence pivoting the lid down, firmly upon loading head 34 until lip edge 86 firmly engages positioning shoulder 88. Lid 78 is then further affixed by the tightening of lid locking screw 84.

Rotation of film turning knob 90 then rotates spring loaded pressure plate 96 against rotary engaging plate 98 until the inner locking projections 100 engage and the reel engaging projections 102 further engage, thus creating a rotatablly engaged connection between turning knob 90 and the interior film reel. Turning knob 90 is then turned, in the required manner depending on the type of reel being used, drawing the film from cassette 60 onto the developing reel. It should be noted that film openings 40 of reel supports 38 are rounded and smooth. The opening 40 for the reciprocating reel supports is placed (when support 38 is inserted) in such a way that the image area of the film does not fricitionally contact the walls of opening 40. Only after the film has been severed from the cassette and the cut end exits passage 64 the curled last section of film (film curls at the end because it is wound around the core of the cassette) briefly touches the sides of entrance 40. The smoothness of the sides of entrance 40 and the lack of tensional friction at that point prevent any possible scratch on the film. The entrance 40 of reel supports 38 for the professional reels contacts the film only at the edges preventing also the possibility of scratches on the image area, and, again, even if there were contact, the smoothness of entrance 40 would not cause film scratching.

It is known that film in a cassette 60 is affixed to an interior part of cassette 60 at an internal end by tape or a similar fixed method to prevent it from being fully removed from the cassette in a camera. When film is completely removed from cassette 60 to the extent permitted by such tape fastening, a substantial increase in resistance to turning will be felt at knob 90. At this point the film is separated from cassette 60 by opening cutter blade opening baffle 74 by pivoting it about its hinge point 76. Removable cutter blade 68 is then inserted within cutter blade passage 70. A substantial edge upon cutter blade 68 severes the film, permitting the knob 90 to be further turned, drawing the remainer of the film upon the reel.

Throughout this process, the film developing reel has been riding rotatably-free and frictionally-supported upon light blocking slide blade 114, which is fully inserted in light slide aperture 106. (In the case of reciprocating reels the entire reel could revolve within support 38 rotatably free, but it is required that only the top flange be free to rotate while bottom flange is pinned by locking pin 48). At the point at which the film has been cut and fully drawn upon the film developing reel, light slide handle 112 is actuated removing light slide 104, thereby opening up the connection between reel chamber 36 and reel receiving chamber 19, permitting the film reel to drop within reel receiving chamber 19. It should be noted here that if the reel being used is a reciprocating type, the locking pin 48 should be withdrawn and locked in this position to release the pressure on the lower flange of reel. Thus permitting it to fall freely when slide 104 is removed. It should also be said here that the inside walls of supports 38 maintain the reel within, in a horizontal position while the slide 104 is being pulled out and said reel does not budge downwards until the last edge of slide 104 has been removed and there is no longer a supporting contact with the reel. This prevents the reel from falling sideways and insures its proper horizontal placement upon bottom cap 6. The cushion 122 of cap 6 absorbs the impact, preventing bouncing. Before the slide 104 is withdrawn the apparatus should be placed in a level surface for obvious reasons. Light blocking slide 104 is then reinserted within light slide aperture 106, isolating reel receiving chamber 19 from reel chamber 36 and maintaining reel receiving chamber 19 in a dark condition.

Reel loading head lid 78 may then be removed by reversing its fastening process, that is, removing locking screw 84 and disengaging locking protrusion 80 from locking notch 82. The now empty film cartridge 60 is removed from the cartridge support aperture 56, disk 98 is removed, a new reel is inserted with cassette and film, and the process is repeated. If need be, and if the new reel is of different design or size than the preceeding reel, the reel support 38 is changed to a different support 38, adapted for the new reel, in which case disk 98 is also replaced by another disc 98 adapted for said new reel.

The process is then repeated until there are not further reels to be loaded or no further films to be removed from their cartridges 60. Tank 2 may be provided with enlarging tank sections. These sections are of the same diameter as tank 2 and at one end of a tank section there is an outer set of threads to match and engage adapting screw section 8 of tank 2. At the other end there is a set of threads exactly like screw section 8 on the inside, to engage either bottom cap 6 or another tank section. So to enlarge tank 2 to accommodate a desired amount of reels, bottom cap 6 is removed, then one or several tank sections are screwably engaged to tank 2 and then bottom cap 6 is engaged on the matching set of threads of the inside bottom of added tank enlarging section, thus providing an enlarged developing tank.

Once tank 2 is full of reeels, slide 104 is reinserted after the last reel has been placed in chamber 19. The lid 78 is removed, engaging disk 98 is removed as well as insert reel support 38. It should be noted here that at this point locking pin 48 would already be locked in a withdrawn position since this is done before pulling out slide 104 to allow reel (if reciprocating type) to drop into tank 2, and if the last reel is the professional type, locking pin 48 is not used and kept withdrawn as well.

Developing cap 20 is then inserted within reel chamber 36 to a point at which engaging threads 30 engage within the inner threads 118 within reel chamber 36.

As stated, inner threads 118 are adapted to form a continuous inner threaded section with inner cap receiving screw 14 of developing tank 2. Developing tank cap 20 is rotated, engaging mutually threads 30 and 118 until seal bottom edge 32 lightly contacts blade 114 of light slide 104.

Sufficient threads at this point have been engaged to form an essentially light-tight contact between cap 20 and loading head 34. Light slide 104 is then removed and cap 20 is further rotated, engaging threads 30 to thread into cap receiving screw 14. The overall length of lower engaging thread section 28 is such that when tank cap 20 is rotated fully into engaging relationship with cap receiving screw 14 so that sealing bottom edge 32 compressibly contacts upper inner cap seel 112, all thread contact has been released with inner threads 118 and there is no physical engagement between cap 20 and loading head 34. At this point, loading head 34 is removed from developing tank 2 by separating tank engaging threads 116, unscrewing them from outer loader adapting screw 16 of developing tank 2. With the removal of loading head 34, developing tank 2 is now seen to be a complete light-tight developing tank adapted for the insertion of chemicals, in a manner well known through fluid receiving cylinder neck 24 of developing tank cap 20. The inner dimensions of chamber 36 allow sufficient clearance to permit the operator to easily introduce his hand to screw cap 20 all the way down to the tank top.

The process of sequentially applying chemicals to the film reel within reel receiving chamber 19 and removing said chemicals by pouring them out of developing tank 2 through the chemical flow passages 27 within tank cap 20 are well known to the art.

It can thus be seen that the invention as described above permits both the sequential loading of a plurality of developing reel, not all of which need be of identical construction one to another, and then the actual chemical development of the film upon these reels, all under daylight conditions, due to the combination of features and interconnections provided so as to adapt developing tank to a specific design of loading head provided as well as a chemically passing, light-tight developing tank cap.

It should be noted that the invention is adaptable to several physical variance from the specific embodiment described herein, and thus should be interpreted in light to cover those embodiments as are implied by the claims.

I claim:

1. An apparatus for daylight loading and developing of at least one roll of photographic film, of the type supplied in a cassette, comprising:

a. a substantially light-tight tank having a vertical chamber therein;

b. a removable, light baffle means, dividing said vertical chamber, into an upper and a lower chamber;

c. a reel loading means in said upper chamber, adapted to receive and load exposed photographic film from a cassette to a reel;

d. wherein said light baffle means is further adapted to move to a first position closing off said lower chamber from introduction of light when said upper chamber is open to receive a reel and a cassette, and is adapted to move to a second position adapted to permit free movement of said reel from said upper chamber to said lower chamber.

2. An apparatus as described in claim 1 above further comprising:

a. means for affixing a light-tight cap, adapted to receive and discharge developing chemicals, to an upper portion of said lower chamber; and b. means for separating said upper chamber from said lower chamber subsequent to the attachment of said light-tight cap.

3. An apparatus as described in claim 1 above wherein said reel loading means further comprises:

a. a removable lid for opening said upper chamber at a top end;

b. reel actuation means axially disposed through said lid for securing and rotating said reel within said upper chamber for loading film from the cassette onto the reel;

c. means for securly holding a cassette of film;

d. light baffle passage for guiding the exposed photographic film from said cassette holding means to said reel in said upper chamber; and e. means for severing said photographic film within said passage.

4. An apparatus as described in claim 2 above wherein said reel loading means further comprises;

a. a removable lid for opening said upper chamber at a top end;

b. means axially disposed through said lid for securing and rotating said reel within said upper chamber, for loading film from the cassette onto the reel;

c. means for securely holding a cassette of film;

d. a light baffle passage for guiding the exposed photographic film from said cassette holding means to said reel in said upper chamber; and e. means for severing said photographic film within said passage.

5. An apparatus as described in claim 2 above further comprising:

a. a removably threaded connection intermediate said upper and said lower chambers, above said light baffle means;

b. inner threads within said vertical chamber extending from a point above said light baffle means to a point below said light baffle means; and c. exterior threads upon the outer periphery of said light-tight cap, adapted to threadingly engage with said inner threads.

6. An apparatus as described in claim 3 above wherein said reel actuation means within said lid further comprise:

a. an outer handle adapted for manipulation by a human hand, exteriorly mounted upon said lid;

b. an anxle coaxially centered along the axis of said reel within said upper chamber, fixedly connected for rotation at its outer ends with said outer handle and said reel for loading the photographic film from the cassette to the reel;

c. pressure plate means rotatably affixed to the inner end of said axle adapted with biasing means for exerting a retaining pressure upon a reel in said upper chamber, further adapted with engaging means for imparting a rotational force to said reel;

d. annular spacing means for centering said reel within said upper chamber, adapted to the passage of film from said film passage means to said developing rrel.

7. A method for loading and developing exposed photographic film, comprising:

a. providing a plurality of cassettes containing exposed photographic film and a plurality of reels adapted to support said photographic film adapted to full chemical contact for development;

b. providing a chamber, cylindrically adapted to holding said reels, divided into an upper and lower portion by an intermediate light-tight removable baffle;

c. inserting a first reel within said upper portion supported upon said baffle;

d. providing a light-tight means for securing and unwinding photographic film from a first cassette onto said first reel;

e. severing said film from said cassette upon completion of winding onto said first reel;

f. removing said light-tight baffle;

g. thereby dropping said reel from said upper portion to said lower portion;

h. reinserting said light-tight baffle, thereby securing said lower portion in a dark condition;

i. repeating the steps c through h until said lower portion is substantially filled with reels;

j. sealing the lower portion with a light-tight cap, having an opening for pouring in and out developing chemicals;

k. removing said upper portion and said light baffle from said lower portion, thereby producing a developing tank containing exposed films adapted to developing said films; and l. attaching said upper portion and said baffle on a second lower portion and repeating step a through k.

* * * * *